US008186275B1

(12) United States Patent
Woodall et al.

(10) Patent No.: US 8,186,275 B1
(45) Date of Patent: May 29, 2012

(54) NON-LETHAL PROJECTILE FOR DISPERSING PAYLOAD UPON TARGET IMPACT

(75) Inventors: Robert Woodall, Panama City, FL (US); Felipe Garcia, Panama City, FL (US); Greg Reitmeyer, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 190 days.

(21) Appl. No.: 12/800,819

(22) Filed: May 17, 2010

(51) Int. Cl.
*F42B 12/36* (2006.01)

(52) U.S. Cl. ..... 102/502; 102/513

(58) Field of Classification Search ..... 102/501, 102/502, 506, 513, 444, 498, 529
See application file for complete search history.

(56) References Cited

U.S. PATENT DOCUMENTS

| | | | | |
|---|---|---|---|---|
| 3,756,155 | A * | 9/1973 | Smith | 102/455 |
| 3,948,263 | A * | 4/1976 | Drake et al. | 102/512 |
| 4,733,611 | A * | 3/1988 | Janay et al. | 102/439 |
| 6,450,100 | B1 * | 9/2002 | Carson | 102/513 |
| 6,722,283 | B1 * | 4/2004 | Dindl et al. | 102/489 |
| 7,934,454 | B2 * | 5/2011 | Campo et al. | 102/502 |
| 2002/0134274 | A1 * | 9/2002 | Martinez et al. | 102/513 |
| 2008/0000464 | A1 * | 1/2008 | Campo et al. | 102/502 |
| 2008/0163779 | A1 * | 7/2008 | Campo et al. | 102/502 |
| 2009/0013893 | A1 * | 1/2009 | Vasel et al. | 102/502 |
| 2009/0266262 | A1 * | 10/2009 | Vasel et al. | 102/370 |

* cited by examiner

*Primary Examiner* — Michael Carone
*Assistant Examiner* — Jonathan C Weber
(74) *Attorney, Agent, or Firm* — James T. Shepherd

(57) ABSTRACT

A non-lethal projectile has an enclosed frangible shell with a nose assembly coupled thereto. The nose assembly is designed to be frangible and absorb shock energy incident on the nose assembly. Frangible containers disposed in the shell occupy a portion of the volume defined thereby such that spaces between the containers are defined. Each container is configured to divide into particles when the container fractures. Each container contains at least one payload material. A gelatinous carbomer fills the spaces between the containers.

29 Claims, 1 Drawing Sheet

NON-LETHAL PROJECTILE FOR DISPERSING PAYLOAD UPON TARGET IMPACT

The invention described herein was made in the performance of official duties by employees of the Department of the Navy and may be manufactured, used, licensed by or for the Government for any governmental purpose without payment of any royalties thereon.

ORIGIN OF THE INVENTION

1. Field of the Invention

The invention relates generally to non-lethal projectiles, and more particularly to a non-lethal projectile that can disperse a payload material over a surface region of a target that is impacted by the projectile.

2. Background of the Invention

Non-lethal weaponry includes a wide variety of "projectiles" and "launchers" such as water cannons, two-part sticky foams sprayed from a nozzle, fragile rounds/projectiles filled with paint, eye or skin irritants, or malodorants. However, each of these types of weaponry is logistically problematic, produces undesirable results, and/or presents unreasonable risks. Water canons require a source of a substantial amount of water and can cause injury/death at short stand-off ranges. Two-part sticky foams require reservoirs of chemical components that must be pumped through separate hoses for mixing at a spray nozzle. Further, it is difficult to control the amount and placement of sticky foam that is dispensed. This can be dangerous if the sticky foam envelopes a person's head thereby impeding their ability to breathe. Conventional frangible and payload-filled rounds/projectiles can have range or accuracy problems, are ineffective in terms of stopping an approaching enemy, or have limited success because a human target can limit or defeat the payload's effectiveness by simply shedding garments struck by the round/projectile.

SUMMARY OF THE INVENTION

Accordingly, it is an object of the present invention to provide a non-lethal projectile.

Another object of the present invention is to provide a non-lethal projectile that can be used to disperse a payload upon target impact.

Still another object of the present invention is to provide a non-lethal projectile that can be used to disperse a variety of payloads or multiple payloads upon target impact.

Other objects and advantages of the present invention will become more obvious hereinafter in the specification and drawings.

In accordance with the present invention, a non-lethal projectile has an enclosed frangible shell that defines a volume. A nose assembly coupled to the shell includes a frangible casing. The nose assembly is designed to absorb shock energy incident on the nose assembly. A plurality of frangible containers are disposed in the shell and occupy a portion of the volume defined thereby such that spaces between the containers are defined. Each container is configured to divide into particles when the container fractures. Each container contains at least one payload material. A gelatinous carbomer fills the spaces between the containers. When the projectile is launched, acceleration forces cause the containers to fracture and the payload materials to begin to mix. At target impact, the nose assembly absorbs enough shock to prevent target penetration thereby allowing the payload materials to spread out over the target surface when the shell fractures.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
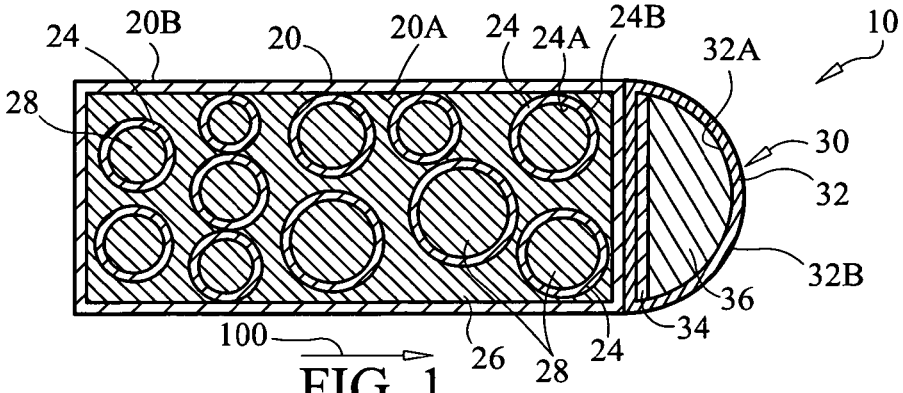
FIG. 1 is a cross-sectional view of a non-lethal projectile in accordance with an embodiment of the present invention.

Referring now to the drawings and more particularly to FIG. 1, a cross-sectional view of a non-lethal projectile in accordance with an embodiment of the present invention is shown and is referred generally by numeral 10. Projectile 10 is illustrated in its pre-use form with the components thereof that present novelty in terms of the non-lethal dispersement of the payload once projectile 10 impacts a target (not shown). It is to be understood that projectile 10 can incorporate or be incorporated with additional conventional projectile elements/components. For example, since projectile 10 will typically be launched using some type of air gun, rifle, etc., such additional conventional projectile elements/components include an external casing or packaging designed to protect projectile 10 during launch, a protective wad designed to fall away from projectile 10 following a launch thereof, a primer and propellant housing coupled to projectile 10, etc. For clarity of illustration, these various conventional projectile elements/components have been omitted from the figures as they are well understood in the art and do not represent limitations of the present invention.

Figure 2:
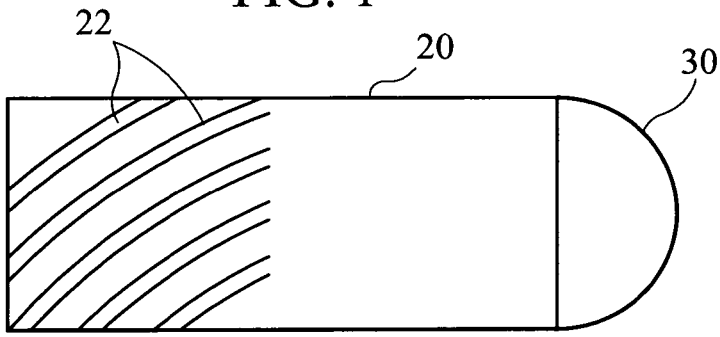
FIG. 2 is a side view of a non-lethal projectile in accordance with another embodiment of the present invention.

Projectile 10 is defined by the following two main body portions: a frangible shell 20 and a nose cone 30 coupled to one end (i.e., the forward end relative to the direction of travel of projectile 10 indicated by arrow 100) of shell 20. Typically, shell 20 will be cylindrical and can have ridges and/or grooves formed on an external radial surface thereof for spin-stabilization purposes. Such ridges and/or grooves are illustrated by curved lines 22 in the side view of projectile 10 presented in FIG. 2. More specifically, spiral-shaped ridges/grooves 22 begin at a central portion of shell 20 and lead to a base bleed at the aft exterior of projectile 10. The purpose of ridges/grooves 22 is to induce trajectory-stabilizing spin when projectile 10 is fired from a smooth-bore gun or one with integrated rifling. The spinning of projectile 10 combined with the base bleed drag reducing effects at the aft end of projectile 10 will allow it to travel farther and straighter than conventional frangible projectiles.

Shell 20 is an enclosed housing made from a plastic material (e.g., a polymeric material such as polyethylene). Shell 20 can be scored on one or both of its internal surfaces 20A and external surfaces 20B in order to facilitate fracture of shell 20 upon target impact by nose cone 30. The particular design of such scoring is not a limitation of the present invention. Note that shell 20 can also be configured to fracture when projectile 10 is launched. In this case, a wad (not shown) will typically be provided about shell 20.

Shell 20 encases a number of frangible containers 24 and a viscous material 26 filling any spaces between containers 24 and internal surfaces 20A of shell 20. Containers 24 can be regularly-shaped (e.g., spherical as shown) or irregularly-shaped, and can be all the same size or different sizes without departing from the scope of the present invention. Containers 24 are configured such that, upon fracture, they are reduced to particles. Such fracture can be initiated by inertial acceleration forces generated during a launch of projectile 10. Accordingly, containers 24 are made from a brittle material such as a crystalline polyarylketone polymer such as the commercially-available polyetheretherketone. (PEEK) family of thermoplastic resins, polyetherketoneketone (PEKK), and polyetherketone (PEK) polymers sold, for example, by Polymics Ltd, State College, Pa. Containers 24 can be scored on one or both of their internal surfaces 24A and external surfaces 24B thereof to create micro-fracture planes. The particular design of such scoring is not a limitation of the present invention.

Each of containers 24 contains a non-lethal payload material 28 that can be the same for all of containers 24 in shell 20. However, and as will be explained further below, a great advantage of the present invention is that several different types of payload materials can be included in shell 20 using containers 24. Typical choices for payload material(s) 28 include malodorants (e.g., skunk essence, cadaverine, etc.), visual marking materials/agents (e.g., paint, chemlune marking materials that are visible under ultraviolet or infrared light, etc.), sticky materials (e.g., expanding sticky foam), materials that are skin irritants (e.g., materials causing itching), and materials that irritate one or more of a person's senses (e.g., cayenne pepper or other materials that irritate one's eye and/or respiratory functions). The constituent parts in containers 24 can also be used to enhance safety of the projectile if the reacting constituents are in containers that are separated by other containers containing payload materials that do not react with the constituents. In this way, inadvertent mild shocks caused during handling will not be sufficient to drive the reacting constituents together.

Containers 24 could also contain constituent parts of a particular payload that mix together when containers 24 fracture. For example, if a payload product of projectile 10 was sticky foam, some of containers 24 could contain one part of a two-part foam while others of containers 24 could contain another part (e.g., a catalyst) of the two-part foam. More specifically, some of containers 24 could contain a monomer containing at least two isocyanate functional groups (e.g., methylene bisphenyl isocyanate) while others of containers 24 could contain another monomer containing at least two hydroxyl alcohol groups in the presence of a catalyst (e.g., xylene).

The present invention allows projectile 10 to deliver and then disperse one or more non-lethal payloads upon impact with a target. Payload mixtures include sticky foam mixed with one or more of malodorants, skin irritants, sensory irritants, and marking agents. Since the sticky foam quantity is readily controlled by projectile 10, the risks associated with hose-dispersed sticky foam are avoided. Further, if one or more other non-lethal payloads are mixed with the sticky foam, their quick removal by an enemy is greatly hampered thereby lengthening their effects. That is, since such sticky foams are not easily wiped off, the useful effects of other payload substances mixed therein are prolonged.

Containers 24 are held in place and protected during normal handling by viscous material 26. However, once projectile 10 is subjected to acceleration forces generated during a launch thereof, viscous material 26 is pressurized. The pressurization of material 26 applies compressive forces on containers 24 that can assist in the fracture of containers 24 into non-lethal particles. At the same time, payload materials 28 are released into viscous material 26. Once released, payload materials 28 begin to mix together within viscous material 26. Then, at target impact, shell 20 fractures (if it has not already done so) and the combination of particlized containers 24, viscous material 26, and payload material(s) 28 collapse, mix together, and spread out on the impacted surface. Viscous material 26 helps keep payload material (s) 28 together thereby giving any required reaction the time needed for success. When sticky foam is included in payload materials 28, the foam and mixed-in materials stick to the target and quickly expand thereon. Premixing in flight helps to ensure effective reactions upon target impact without the need for excess heat that could damage the target.

Viscous material 26 can be a variety of materials provided it supports the above-described function and does not create adverse reactions with payload material(s) 28 released therein. A suitable choice for material 26 is a gelatinous carbomer that, for the present invention, is defined as homopolymers of acrylic acid cross-linked with an allyl ether pentaerythritol, allyl ether of sucrose, or allyl ether of propylene. Note that viscous material 26 can also be selected to enhance the effects of payload material(s) 28 released from containers 24.

Since projectile 10 must be non-lethal and since the contents of shell 20 are meant to be dispersed on a target surface, nose cone 30 is designed to absorb enough target-impact shock energy to prevent target surface penetration, directly block any hard particles from perpendicular impingement on the target, and aid in the mixing/dispersing of the contents of shell 20 as it fractures. An embodiment of nose cone 30 that accomplishes these functions is illustrated. Nose cone 30 includes a frangible nose casing attached to the forward end of shell 20 designed to fail/fracture upon target impact. A shock absorbing system is disposed in casing 32. For example, in the illustrated embodiment, a rigid plate 34 (e.g., circular disk in the case of a cylindrical shell 20) is positioned but not fixed in casing 32 adjacent to the forward end of shell 20 as illustrated. The remainder of casing 32 is filled with a material 36 that will act to limit the shock felt by a target upon impact. Material 36 can be a column of air or other compressible impact reducing material. The shock absorbing mechanism of this structure will be explained further below.

Figure 3A:
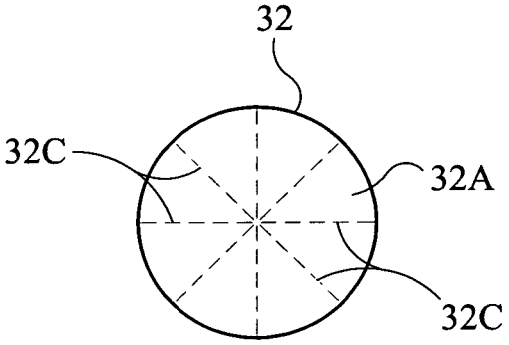
FIG. 3A is a plan view of the internal surface of the projectile's nose casing illustrating an exemplary score pattern that causes the nose to deform into a petal-like shape when the nose strikes a target in accordance with an embodiment of the present invention.
Figure 3B:
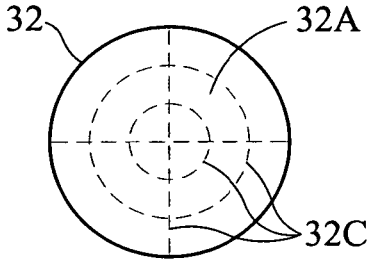
FIG. 3B is a plan view of the internal surface of the projectile's nose casing illustrating an exemplary score pattern that causes the nose to deform into a petal-like shape when the nose strikes a target in accordance with another embodiment of the present invention.
Figure 3C:
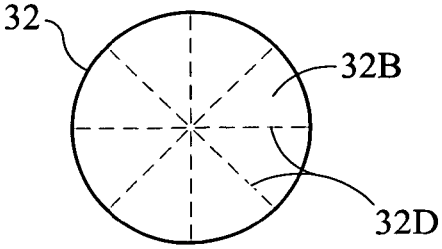
FIG. 3C is a plan view of the external surface of the projectile's nose casing illustrating an exemplary score pattern that causes the nose to deform into a petal-like shape when the nose strikes a target in accordance with another embodiment of the present invention.
Figure 3D:
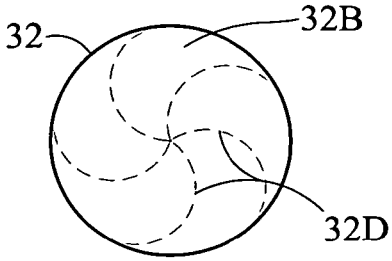
FIG. 3D is a plan view of the external surface of the projectile's nose casing illustrating an exemplary score pattern that causes the nose to deform into a petal-like shape when the nose strikes a target in accordance with another embodiment of the present invention.

As mentioned above, casing 32 is designed to fail/fracture upon target impact. Accordingly, casing 32 can be made from a frangible polymeric material (e.g., polyethylene) and can be scored on one or both of internal surfaces 32A and external surfaces 32B thereof without departing from the scope of the present invention. For example, two internal score patterns are illustrated in FIGS. 3A and 3B where each exemplary score pattern (illustrated by dashed lines 32C) facilitates the petaling out of casing 32 to a larger area thereby reducing the pressure of impact. The resulting nose petal formed when casing 32 strikes a target also protects the target from the rapidly following frangible projectile components thereby insuring the non-lethality attributes of the present invention. Exemplary external score patterns 32D are illustrated in FIGS. 3C and 3D. External score patterns 32D also facilitate the petaling out of casing 32 to a larger area thereby reducing the pressure of impact while offering protection from frangible projectile components. It is to be understood that external score patterns 32D are also representative of shallow channels in the same configuration. Such channels would serve the same purpose as score patterns 32C, but additionally channel air flow over casing 32 during projectile flight to improve the projectile's aerodynamic characteristics.

In operation, when projectile 10 is launched, acceleration forces act on the contents of shell 20 whereby containers 24 fracture as described above to begin mixing of the payload material(s) 28. At target impact, plate 34 continues on in direction of travel 100 to squeeze material 36 as casing 32 fails in a prescribed fashion so that nose cone 30 provides an impact dampening function. Then, as shell 20 hits the target, impact forces are reduced to non-lethal levels while still providing the necessary force to fracture shell 20. The contents of shell 20 are then free to further mix and disperse over the surface of the target.

The advantages of the present invention are numerous. One or more non-lethal payload materials can be delivered efficiently, accurately, and in readily-controlled quantities. The approach described herein is readily adaptable to a variety of projectile/round designs and sizes. When the projectile's payload materials include sticky foam or the components thereof, any additionally-delivered payload materials are not readily removed from an impacted target thereby increasing the effectiveness of the payload materials.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A non-lethal projectile, comprising:
an enclosed frangible shell defining a volume;
a nose assembly coupled to said shell, said nose assembly including a frangible casing and means for absorbing shock energy incident on said nose assembly;
a plurality of frangible containers disposed in said shell and occupying a portion of said volume wherein spaces between said containers are defined, each of said containers configured to divide into particles when each of said containers fractures;
at least one payload material disposed in each of said containers; and
a gelatinous carbomer filling said spaces.

2. A non-lethal projectile as in claim 1, wherein said shell is made from a polymeric material.

3. A non-lethal projectile as in claim 1, wherein said shell is scored on at least one of internal surfaces and external surfaces thereof.

4. A non-lethal projectile as in claim 1, wherein said casing of said nose assembly is made from a polymeric material.

5. A non-lethal projectile as in claim 1, wherein said casing of said nose assembly is scored on at least one of internal surfaces and external surfaces thereof.

6. A non-lethal projectile as in claim 1, wherein said means for absorbing shock energy comprises:
a rigid plate in said casing at a location therein that is adjacent to said shell; and
shock dampening material abutting said plate and filling said casing.

7. A non-lethal projectile as in claim 1, wherein said at least one payload material is selected from the group consisting of a malodorant, a visual marking material, a sticky material, a skin irritant, a sensory irritant, and constituents and catalysts thereof.

8. A non-lethal projectile as in claim 1, wherein each of said containers is made from a crystalline polyarylketone polymer.

9. A non-lethal projectile as in claim 1, wherein each of said containers is scored on at least one of internal surfaces and external surfaces thereof.

10. A non-lethal projectile as in claim 1, wherein a radial external surface of said shell incorporates at least one of spin-stabilizing ridges and spin-stabilizing channels.

11. A non-lethal projectile, comprising:
an enclosed frangible shell defining a volume;
a nose assembly coupled to one end of said shell, said nose assembly including a frangible casing and means for absorbing shock energy incident on said nose assembly;
a plurality of frangible containers disposed in said shell and occupying a portion of said volume wherein spaces between said containers are defined, each of said containers made from a crystalline polyarylketone polymer that is configured to divide into particles when each of said containers fractures;
at least one payload material disposed in each of said containers; and
a gelatinous carbomer filling said spaces.

12. A non-lethal projectile as in claim 11, wherein said shell is made from a polymeric material.

13. A non-lethal projectile as in claim 11, wherein said shell is scored on at least one of internal surfaces and external surfaces thereof.

14. A non-lethal projectile as in claim 11, wherein said casing of said nose assembly is made from a polymeric material.

15. A non-lethal projectile as in claim 11, wherein said casing of said nose assembly is scored on at least one of internal surfaces and external surfaces thereof.

16. A non-lethal projectile as in claim 11, wherein said means for absorbing shock energy comprises:
a rigid plate in said casing at a location therein that is adjacent to said end of said shell; and
shock dampening material abutting said plate and filling said casing.

17. A non-lethal projectile as in claim 11, wherein said at least one payload material is selected from the group consisting of a malodorant, a visual marking material, a sticky material, a skin irritant, a sensory irritant, and constituents and catalysts thereof.

18. A non-lethal projectile as in claim 11, wherein each of said containers is scored on at least one of internal surfaces and external surfaces thereof.

19. A non-lethal projectile as in claim 11, wherein a radial external surface of said shell incorporates at least one of spin-stabilizing ridges and spin-stabilizing channels.

20. A non-lethal projectile, comprising:

an enclosed frangible shell defining a volume;

a nose assembly coupled to a forward end of said shell, said nose assembly including a frangible casing and means for absorbing shock energy incident on said nose assembly, said casing configured to deform to a petalous shape when shock energy is incident on said nose assembly;

a plurality of frangible containers disposed in said shell and occupying a portion of said volume wherein spaces between said containers are defined, each of said containers configured to divide into particles when each of said containers fractures;

at least one payload material disposed in each of said containers; and a gelatinous carbomer filling said spaces.

21. A non-lethal projectile as in claim 20, wherein said shell is made from a polymeric material.

22. A non-lethal projectile as in claim 20, wherein said shell is scored on at least one of internal surfaces and external surfaces thereof.

23. A non-lethal projectile as in claim 20, wherein said casing of said nose assembly is made from a polymeric material.

24. A non-lethal projectile as in claim 20, wherein said casing of said nose assembly is scored on at least one of internal surfaces and external surfaces thereof.

25. A non-lethal projectile as in claim 20, wherein said means for absorbing shock energy comprises:

a rigid plate in said casing at a location therein that is adjacent to said forward end of said shell; and shock dampening material abutting said plate and filling said casing.

26. A non-lethal projectile as in claim 20, wherein said at least one payload material is selected from the group consisting of a malodorant, a visual marking material, a sticky material, a skin irritant, a sensory irritant, and constituents and catalysts thereof.

27. A non-lethal projectile as in claim 20, wherein each of said containers is made from a crystalline polyarylketone polymer.

28. A non-lethal projectile as in claim 20, wherein each of said containers is scored on at least one of internal surfaces and external surfaces thereof.

29. A non-lethal projectile as in claim 20, wherein said shell is cylindrical and wherein a radial external surface of said shell incorporates at least one of spin-stabilizing ridges and spin-stabilizing channels.

* * * * *